United States Patent [19]

Zurmahr

[11] 4,088,309

[45] May 9, 1978

[54] COOLING DEVICE FOR SLABS WITH SLAB-TILTING DEVICES FOR TURNING THE ROLLED STOCK

[75] Inventor: Horst Zurmahr, Ratingen, Germany

[73] Assignee: Sack GmbH, Düsseldorf-Rath, Germany

[21] Appl. No.: 735,076

[22] Filed: Oct. 22, 1976

[30] Foreign Application Priority Data

Oct. 28, 1975 Germany ..... 2548154

[51] Int. Cl.[2] ..... C21D 1/62

[52] U.S. Cl. ..... 266/130; 266/132

[58] Field of Search ..... 72/201, 202; 62/64, 62/373; 214/1 BB, 38 CA; 266/130, 132

[56] References Cited

U.S. PATENT DOCUMENTS

| | | | |
|---|---|---|---|
| 3,241,686 | 3/1966 | Hurst | 214/38 CA |
| 3,895,498 | 7/1975 | Manthey et al. | 266/132 X |

FOREIGN PATENT DOCUMENTS

| | | | |
|---|---|---|---|
| 4,616,243 | 6/1971 | Japan | 266/132 |

*Primary Examiner*—Roy Lake
*Assistant Examiner*—Paul A. Bell
*Attorney, Agent, or Firm*—John J. Dennemeyer

[57] ABSTRACT

Cooling device for slabs comprising a cooling trough and a locating frame provided with compartments in the cooling trough for the vertical location of the slabs by means of a crane able to travel on a track above or along the cooling trough, which crane engages the slabs in an upright position with suitable gripper devices and places them in the locating frame or lifts them from the latter after cooling. The apparatus further comprises two independent tilting devices in the region of the delivery and discharge roller beds for placing the slabs in an upright position and a flat position. The two independent tilting devices are located in the region of the same end of the slab-cooling trough and staggered with respect to each other such that the center-to-center distance of two slabs placed in an upright position by the latter and located in the range of the travelling crane corresponds to the center-to-center distance between the compartments of the locating frame.

8 Claims, 3 Drawing Figures

COOLING DEVICE FOR SLABS WITH SLAB-TILTING DEVICES FOR TURNING THE ROLLED STOCK

The invention relates to a cooling device for slabs, consisting of a cooling trough for receiving cooling water and of a locating frame with compartments, provided in the cooling trough, for the vertical location of the slabs by means of a crane able to travel on a track above or along the cooling trough, which crane engages the slabs in the upright position by means of suitable gripper devices and locates them in the locating frame or removes them from the latter after cooling and of two independent tilting devices in the region of the delivery and discharge roller beds for placing the slabs in the upright position and laying them down.

A cooling device of the afore-described type is known from German Offenlegungsschrift 2,002,272, which corresponds to U.S. Pat. No. 3,680,344. In the case of this cooling trough, roller beds for the delivery or discharge of the slabs extend along both end faces. Accordingly, a tilting device is required at each end face of the cooling trough, which device tilts the individual slabs into an upright position or receives them in an upright position, in which position they are removed by one or more cranes with gripper devices travelling above the trough, or from which position they may be tilted back onto their flat surfaces for transfer to the discharge roller bed. Thus, each gripper device is able to receive only one slab, which results in a relatively low transport frequency when using only one travelling crane, since one crane has to be used both to deposit the hot slabs and remove the cooled slabs.

When using two cranes, their operating capacity is again impaired by the intersection of the transport paths. Therefore, in recent times, slab-cooling installations of the said type have been constructed with only one crane and the gripper devices are thus constructed such that two slabs may be picked up. The gripper devices may be constructed as shown in German Offenlegungsschrift No. 2,158,091 which corresponds to U.S. Pat. No. 3,895,498, or other gripper devices fulfilling the same function may be used, for example according to Gebrauchsmuster 74,13,575. It is thus possible to engage a slab to be cooled coming from the tilting device of the delivery roller bed and to place the latter in an empty compartment of the cooling trough and at the same time to lock a cooled slab in the second holder of the gripper device, so that the latter can be removed and deposited in the tilting device in front of the discharge roller bed.

If a favourable transportation frequency is to be achieved, with the afore-described installation it is absolutely necessary — apart from the gripper device with two holders — to provide separate roller beds at both ends of the trough and then to associate a tilting device with each roller bed.

However, it will not always be possible to equip a cooling trough with separate discharge and delivery roller beds. On the contrary, for reasons of space, it is frequently necessary to operate with only a main roller bed in front of the same end face of the cooling trough, as is described in Japanese Patent Specification No. 624,686 for example. However, in such a case, the transportation frequency and thus the successive transportation of slabs is considerably restricted, since the following sequence takes place: a slab to be cooled is conveyed as far as the cooling trough lying face-down on a roller bed. At this point, the slab is picked-up by a tilting device and brought into an upright position standing on one end face. Then, the gripper devices of the crane engage the slabs and deposit them in a free compartment of the locating frame in the cooling trough. At the same time, the adjacent cooled slab is engaged by the second holder of the gripper device, raised out of the cooling trough after being locked and once more carried to the tilting device in order to be deposited on the latter. The gripper devices of the crane are raised into a waiting position with the lifting bridge supporting them, whereupon the tilting device tilts the cooled slab back onto the roller bed. The roller bed conveys the cold slab further and then brings a new slab to be cooled in front of the cooling device.

To provide the shortest possible interval between slabs, the following times have to be added:

a. the time for the working cycle of the handling device;
b. the time taken by the tilting device for tilting the cooled slabs back onto the roller bed;
c. the time taken for the discharge of the cold slabs on the roller bed and the subsequent supply of the new slab to be cooled;
d. the time taken for standing the slab to be cooled on its narrow end face.

The object of the invention is to construct a slab-cooling device such that the bottle necks in the flow of material occuring in the feed of known slab-cooling installations are avoided and in particular, the transportation frequency may be arranged such that the succession of slabs is considerably increased. To solve this object, the invention proposes that both tilting devices are located in the region of the same end of the slab-cooling trough and are staggered with respect to each other such that the centre-to-centre distance between two slabs placed in an upright position by the latter and located within the range of the travelling crane corresponds to the centre-to-centre distance of adjacent compartments of the locating frame.

Since two tilting devices now operate in front of the end of the cooling trough located adjacent the roller bed, it is no longer necessary for the travelling crane to assume a waiting position. On the contrary, the travelling crane may come into action without delay and in an unhindered manner, since in every case, the region of the cooling trough is quickly cleared or prepared, one tilting device always being available for the cold slab and a second tilting device being available exclusively for the slab still to be cooled. Thus it is immaterial whether the slab to be cooled is placed on its narrow end face before reaching the front end of the cooling trough and is transported to the cooling trough in this lateral position, or whether the slab to be cooled is placed in the upright position at the end of the cooling trough and the cold slab is sent to the second tilting device for turning, in its lateral position. However, it is always important that a hot slab is ready in the upright position, which the travelling crane may engage with its gripper devices without delay after depositing the cold slab with the second holder. Thus, it is only necessary to take into consideration the working cycle of the travelling crane to produce the shortest possible interval between slabs.

One embodiment of the invention provides that the tilting device receiving the hot slabs at the inlet side is located in the range of the travelling crane and located between this tilting device and the front end of the cooling trough is an auxiliary roller bed with driven rollers receiving cooled slabs in the upright position, which roller bed extends outside the range of the travelling crane and into the range of the tilting device at the outlet side.

Additional embodiments of the cooling device according to the invention are also contemplated, including locating both tilting devices laterally outside the range of the traveling crane and providing roller beds for each, and locating both tilting devices side-by-side within the range of the travelling crane with a roller bed for each device. This latter construction, in which the main roller bed is divided into two individual roller beds, makes it possible to provide a stationary abutment at the end of the delivery roller bed, against which the slab may abut and be stopped in an exact position for transfer to the tilting device, whereas otherwise it is necessary to provide an electrical control by means of photo-electric cells and d.c. motors or projections which may be raised and lowered. The factors affecting which embodiment of the invention to employ include available space for the equipment, ease of inspection, and accessibility for making repairs and the like.

The invention is illustrated in detail in the drawings and in particular

Figure 1:
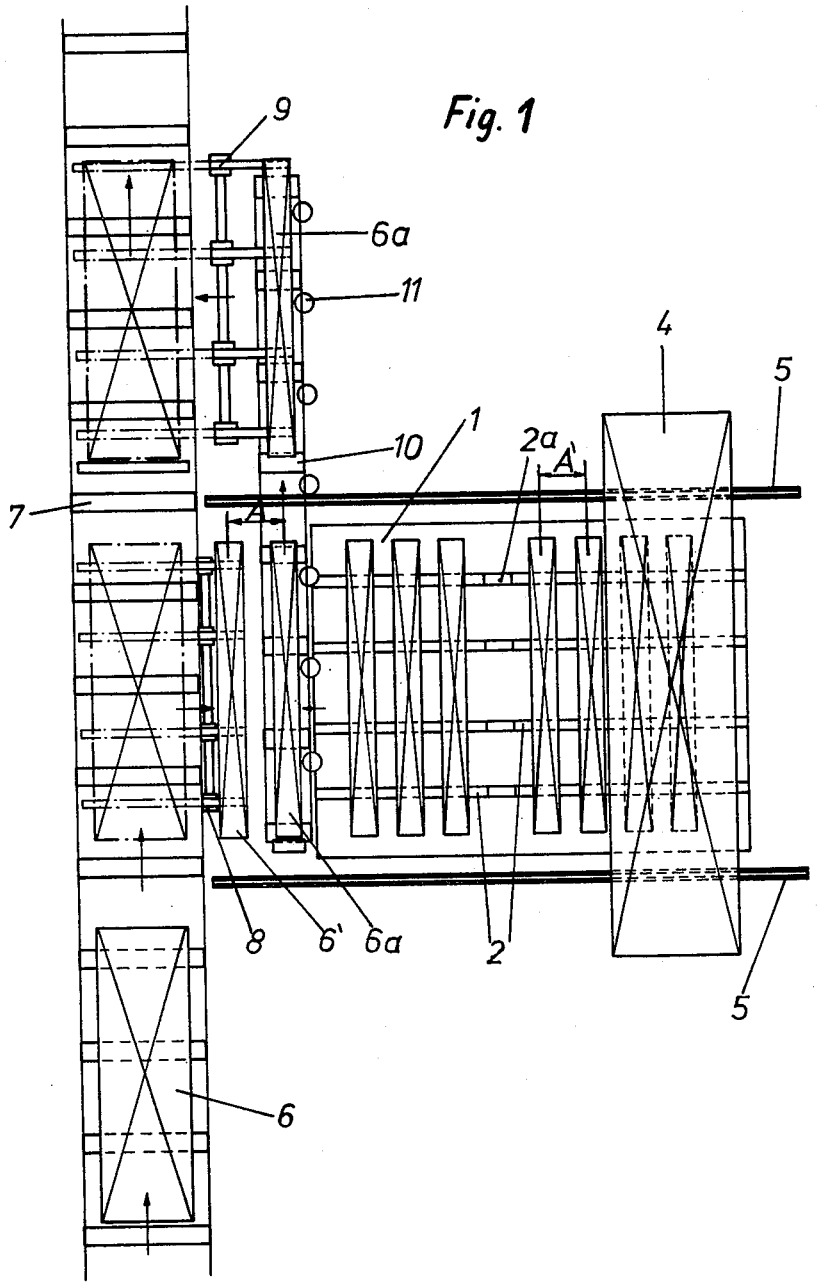
FIG. 1 is a diagrammatic illustration of the slab-cooling installation according to the invention in plan view with a tilting device located laterally adjacent the front end of the cooling trough and a tilting device located at the front end of the cooling trough.
Figure 2:
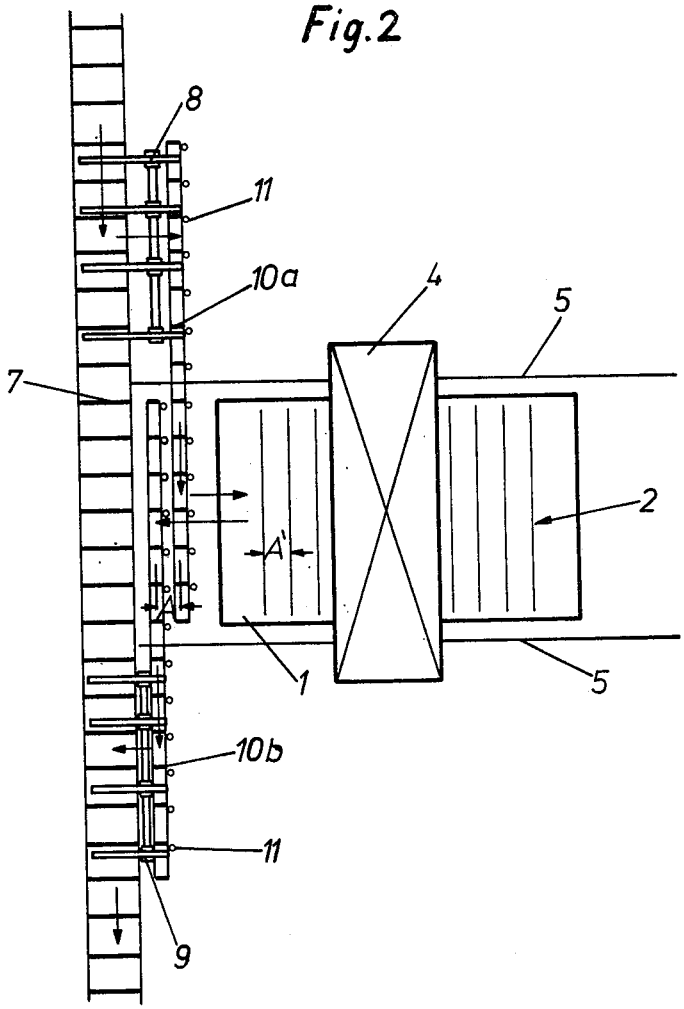
FIG. 2 is a plan view of a slab-cooling installation with both tilting devices located laterally adjacent the cooling trough and FIG. 3 is a plan view of a slab-cooling installation with separate delivery and discharge roller beds located in front of one end of the cooling trough and slab-tilting devices respectively associated with the latter.
Figure 3:
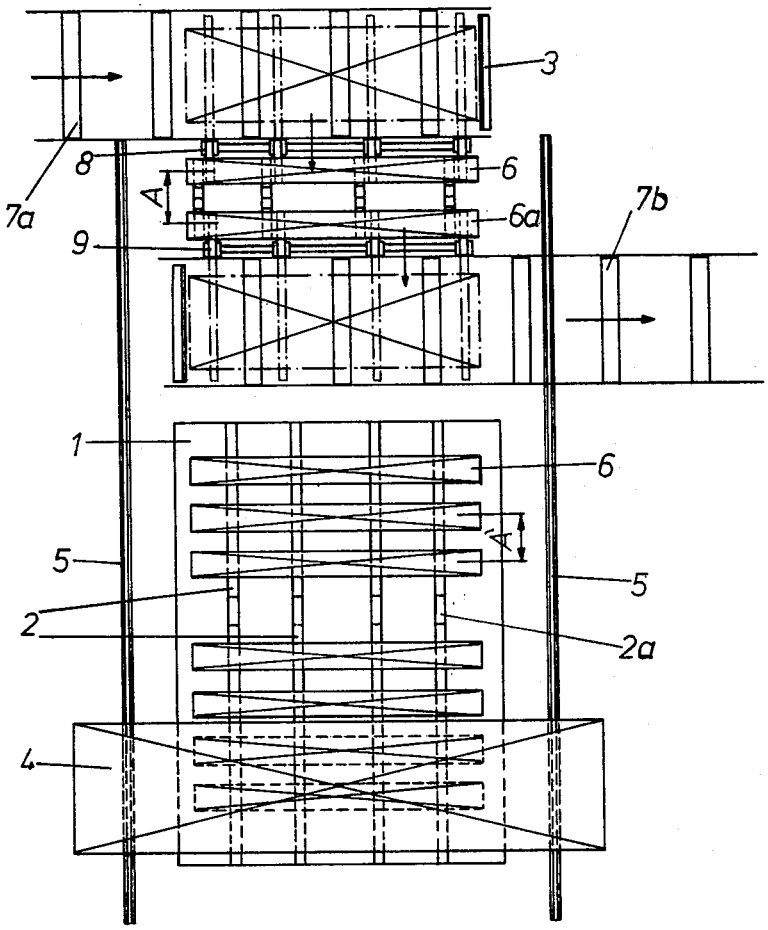

FIGS. 1 to 3 all show a cooling trough 1, which serves to receive a locating frame 2 provided with compartments 2*a*. The slabs introduced have an equal centre-to-centre distance A'. By means of the travelling crane 4, which is able to travel on rails 5 above or along the cooling trough 1, an arriving slab 6 in the upright position 6' may be engaged by gripper devices (not shown) of the travelling crane 4 and deposited in an empty compartment 2*a* of the locating frame or removed from the compartment. However, for this, the incoming slab 6 lying flat on a roller bed 7 must firstly be brought into an upright position standing on its narrow side face, and after cooling must be brought out of its upright position into a flat position. This work is undertaken by two independent tilting devices 8 and 9, which are both located at the same end of the cooling trough. The tilting device 8 ensures that the slabs 6 supplied are placed on their narrow end face, whereas the other tilting device 9 tilts the cooled slabs back onto the roller bed.

In the slab-cooling installation according to FIG. 1, the hot slab 6, lying on a roller bed 7, passes to the first tilting device 8 provided at one end face of the cooling trough 1. The tilting device 8 tilts the slab 6 through 90° and then places the latter in the upright position 6'. In the meantime, the travelling crane 4 with the gripper devices (not shown) constructed as a double holder in the manner of the double grasping devices shown in said U.S. Pat. No. 3,895,498, for example, has engaged the cooled slab 6*a*, raised it from the cooling trough and brought it to an auxiliary roller bed 10 located directly in front of the end face of the cooling trough. As the cold slab 6*a* is lowered onto the auxiliary roller bed 10, the hot slab 6' already in the upright position is engaged by the second holder of the gripper device, since the centre-to-centre distance A of the two slabs 6' and 6*a* corresponds to the centre-to-centre distance A' of the compartments 2*a* of the locating frame. After the cold slab 6*a* has come to lie on the auxiliary roller bed 10, a locking mechanism of the gripper devices, which is not shown and described in detail since a suitable arrangement is described in said U.S. Pat. No. 3,895,498, for example, can be reversed so that the cold slab 6*a* is released and on the other hand the hot slab 6' is engaged and locked in the second holder. After this, the travelling crane 4 may begin its journey to the cooling trough without further delay. Meanwhile, the cold slab 6*a* on the auxiliary roller bed is conveyed to a second tilting device 9 located laterally outside the range of the travelling crane 4, the slab being secured in the upright position by vertical guide rollers 11. The tilting device 99 tilts the cold slab 6*a* back onto the roller bed 7 and as the cold slab is discharged, a hot slab is conveyed in front of the first tilting device 8 and brought into the upright position. The travelling crane may thus operate without interruption, since it is not necessary to await either the delivery of a hot slab nor the discharge of a cold slab.

FIGS. 2 and 3 show further possibilities for the construction of a slab-cooling installation according to the invention with two tilting devices at one end of the cooling trough. According to FIG. 2, both tilting devices 8, 9 are located laterally outside the range of the travelling crane 4 so that a tilting device is respectively located adjacent each side of the cooling trough. From each tilting device, an auxiliary roller bed 10*a*, 10*b* with guide rollers 11 arranged vertically with respect to the roller bed or guide runners arranged laterally leads so far to the front end of the cooling trough that after being brought into the secured upright position on the auxiliary roller bed 10*a* by the tilting device 8, a hot slab can be conveyed in a position which enables the travelling crane 4 to engage the slab without complications or, in the case of a cold slab, to supply the latter to the auxiliary roller bed 10*b* without difficulties. On the auxiliary roller bed 10*b*, the cold slab is conveyed to the tilting device 9, where the slab is tilted through 90° into the flat position and supplied to the roller bed 7 for discharge. Otherwise, the further sequence of operations corresponds to the sequence already described for a cooling installation according to FIG. 1. In this case, it is also ensured that a hot slab is ready when a cold slab is discharged. Waiting or idle times are thus eliminated. The centre-to-centre distance of the auxiliary roller beds 10*a* and 10*b* is in this case also equal to the centre-to-centre distance of the compartments A'.

The aforesaid is also true for a slab-cooling installation according to FIG. 3, which comprises separate roller beds 7*a*, 7*b* in front of an end face of the cooling trough, in place of the individual main roller bed 7 for the supply and discharge of slabs. Seen in the direction of the material flow, the delivery roller bed 7*a* may thus end in alignment with a longitudinal wall defining the width of the cooling trough, where the roller bed 7*a* thus comprises an abutment 3, against which the slab may bear and be stopped in an accurate position, whereas the discharge roller bed 7*b* is continued from the longitudinal wall defining the width of the cooling trough. The two roller beds, *7a, 7b* are at a distance apart such that two independent tilting devices 8, 9 may be associated with the delivery as well as the discharge roller bed, which devices assume a position in front of the end face of the cooling trough between the delivery and discharge roller beds *7a, 7b.* The tilting device 8 places the slab in an upright position and the tilting device 9 tilts the cold slab *6a* on to the discharge roller bed for further conveyance.

What is claimed is:

1. Cooling apparatus for slabs, comprising:

a cooling trough for receiving cooling water, and having front and rear ends;

a locating frame located in said cooling trough, and provided with substantially evenly spaced, adjacent compartments for receiving upright hot slabs to be cooled;

traveling crane means mounted above said cooling trough for movement therealong between said front and rear ends thereof, and including two side-by-side gripper devices having center lines spaced apart a distance corresponding to the distance between the center lines of said locating frame compartments, said traveling crane means and said gripper devices being adapted to grip an upright hot slab positioned at the front end of said cooling trough and deposit it in one of said compartments, and to grip an upright cooled slab and move it from one of said compartments to said front end;

first tilting device means arranged at the front end of said cooling trough, and adapted to receive and tilt an incoming hot slab from a flat position to an upright position;

second tilting device means also arranged at the front end of said cooling trough, and adapted to tilt an outgoing cooled slab from an upright to a flat position;

said first and said second tilting device means being independent of each other, and being placed with their centerlines spaced apart substantially the same distance as the centerlines of said gripper devices; and roller bed means associated with said first and said second tilting device means, and adapted to deliver hot slabs to said cooling apparatus and to remove cooled slabs therefrom.

2. Cooling apparatus according to claim 1, wherein said first tilting device means is located in the range of said traveling crane means, and located between this tilting device and the front end of said cooling trough is an auxiliary roller bed with driven rollers for receiving cooled slabs in the upright position, which auxiliary roller bed extends outside the region of the traveling crane means in a direction transverse to the direction of travel thereof, said second tilting device means being spaced from said traveling crane means in said transverse direction.

3. Cooling apparatus according to claim 2, wherein both said first and said second tilting device means are associated with a single, continuous roller bed serving simultaneously as a delivery and a discharge roller bed, said auxiliary roller bed and said second tilting device means being arranged to place a cooled slab on said continuous roller bed in a flat position.

4. Cooling apparatus according to claim 1, wherein both said first and said second tilting device means are located laterally outside the range of the traveling crane means, and auxiliary roller beds with driven rollers are provided for conveying slabs in an upright position between said tilting devices and said traveling crane means, which roller beds overlap in the range of the traveling crane means at said front end of said cooling trough.

5. Cooling apparatus according to claim 4, wherein the auxiliary roller bed associated with said first tilting device means at the inlet side of said cooling apparatus is located between the auxiliary roller bed associated with said second tilting device means at the outlet side of said apparatus and the front end of the cooling trough.

6. Cooling apparatus according to claim 4, wherein both said first and said second tilting device means are associated with a single continuous roller bed serving simultaneously as a delivery and discharge roller bed, said tilting device means and said auxiliary roller beds being arranged to remove hot slabs from said continuous roller bed and to place cooled slabs thereon.

7. Cooling apparatus according to claim 1, wherein said first and said second tilting device means are arranged directly side-by-side in the range of the traveling crane means along the path of travel thereof and at the front end of said cooling trough, and wherein located laterally beside each tilting device means is a roller bed for conveying slabs in a flat position.

8. Cooling apparatus according to claim 7, wherein one of said roller beds is a delivery roller bed and is located outside of said tilting devive means, and wherein the other of said roller beds is a discharge roller bed, and is located immediately adjacent the front end of the cooling trough inside of said tilting means.

* * * * *